United States Patent [19]

Cross

[11] 4,288,935

[45] Sep. 15, 1981

[54] DISPLAY BOOK APPARATUS

[76] Inventor: Carroll N. Cross, Rte. 2, Box 741, Maitland, Fla. 32751

[21] Appl. No.: 99,075

[22] Filed: Nov. 30, 1979

[51] Int. Cl.[3] ..... G09D 3/04

[52] U.S. Cl. ..... 40/120; 40/124.1; 40/530

[58] Field of Search ..... 248/459; 281/15 R, 15 B; 40/120, 530, 124.1

[56] References Cited

U.S. PATENT DOCUMENTS

| | | | |
|---|---|---|---|
| 1,974,814 | 9/1934 | Hall | 281/15 B |
| 2,978,824 | 4/1961 | Paschal | 40/120 |
| 3,013,359 | 12/1961 | Cross et al. | 40/120 |
| 3,370,368 | 2/1968 | Paschal | 248/459 |
| 4,143,847 | 3/1979 | Cross | 281/15 B |

*Primary Examiner*—G. E. McNeill
*Assistant Examiner*—Wenceslao J. Contreras
*Attorney, Agent, or Firm*—Duckworth, Hobby, Allen, Dyer & Pettis

[57] ABSTRACT

A display and book combination allows for a calendar combination which swings to give access to a phone or reference book. The display is foldable into a flat position for shipping and is easily set up by folding a support panel on a base panel from a flat to an upright position where it supports the book pages and a calendar display panel.

9 Claims, 4 Drawing Figures

DISPLAY BOOK APPARATUS

BACKGROUND OF THE INVENTION

The present invention relates to displays, such as calendar displays, and to a combination of such a display with a quick reference phone or reference book.

In the past, a great variety of displays for displaying calendars and the like have been provided. Typically, these display mounts are made of cardboard which has a plurality of calendar leaves attached by staples, stitches, or placed in pockets on the display mount. The display may be provided with some means for supporting the display, such as having a rear hinged panel and a tongue connecting one panel to the other to hold the panels in position. It has also been common in the past to provide a wide variety of reference books placed for handy use adjacent a telephone, such as may be attached to the phone to provide a ready reference for phone numbers, addresses, and other commonly used information. These prior type displays and phone books are frequently provided free by companies to their customers and potential customers with their advertising material printed on the display mount or on the reference books. The present invention is directed toward a multi-use calendar display which may contain conventional advertising material thereon, which also has a phone or reference book formed therein in which the display mount acts as a cover for the book.

Typical display mounts for calendar pads and the like may be seen in my prior U.S. Pat. No. 2,355,706 for a display mount having a well in the face thereof for displaying materials such as calendar pads, and in U.S. Pat. No. 3,058,410 and U.S. Pat. No. 3,079,715 for an improved display mount structure and improved method for forming the display windows and display wells in display mount structures. In addition, my prior patents on display and photomounts may be seen in U.S. Pat. No. 3,216,582; U.S. Pat. No. 3,068,139; and U.S. Pat. No. 3,002,720, which include my patent on an aluminum hinge which allows a supporting prop or other display mount supports to be mounted with a flexible hinged panel which stays in place without the use of interconnecting tongues, or the like.

The present invention, advantageously, provides a folded position for easy shipment of a calendar display and reference book which may be easily set up for use, and which provides the usual display for advertising material, as well as additional space in the reference book for advertising, such as by a plurality of advertisers or for the reproduction of photographs or artwork in addition to space for phone numbers and addresses.

SUMMARY OF THE INVENTION

A display and book combination has a base panel having an upright support panel connected thereto and having an aluminum hinge between the base panel and upright support panel so that the upright support panel can be folded flat or into different upright positions. A display panel is flexibly hinged to the base panel at its forward end and supported by the upright panel in its angularly disposed position, but may be folded flat parallel to the base panel and the upright support panel when the upright support panel is folded flat. A plurality of book pages are secured to the hinged portion between the display panel and the base panel and supported by the upper end of the upright support panel in its upright position, and adapted to be folded flat parallel to the base panel and upright support panel when the upright support panel is folded flat. The pages may be held in position to the display by staples or other fastening means, as desired, and the display panel may be swung forward to allow rapid access to the book pages.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 4:
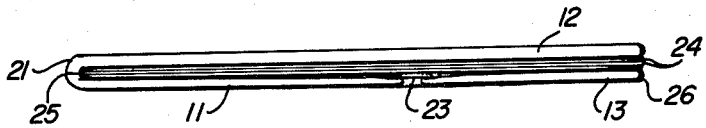
FIG. 4 is a side elevation of the display book combination in a folded position.

Referring now to the drawings, a display mount and book 10 is illustrated having a base panel 11, a front display panel 12 and an upright support panel 13. The display panel 12 may have printing 14, such as advertising material, printed on the front thereof, and may have a display calendar 15 inserted in a pocket 16 held down by overlapping sides 17 and an overlapping bottom 18, if desired. Display panel 12 may be made of one, two or three paperboard panels casebound with one panel cut out to form the pocket 16. All panel edges may be die cut. The base panel 11 may also be casebound and may have lines of printed information 20 thereon. A flexible hinged area 21 connects the base panel 11 and the face panel 12 which may be hinged with the case binding overlapping the two panels, while the upright support panel 13 may be hinged with the case binding at 22 and may also have a thin aluminum strip forming an aluminum hinge 23, which has been covered with either the case binding or the printed surface 20. The aluminum hinge 23 will allow the upright portion 13 to be folded flat, as illustrated in FIG. 4, or to be held upright in different positions without tongue-type fasteners, thereby allowing additional space on the base panel 11 for storing pencils, pens, or loose paper or letters. A multi-page book portion 24 has a plurality of sheets held at the hinged area 21 between the front panel 12 and the base panel 11 and may be held in position by staples 25 or by other fastening means, as desired. Pages 24 extend a sufficient length to rest on the top edge 26 of the upright support panel 13 beneath the display panel 12.

Figure 1:
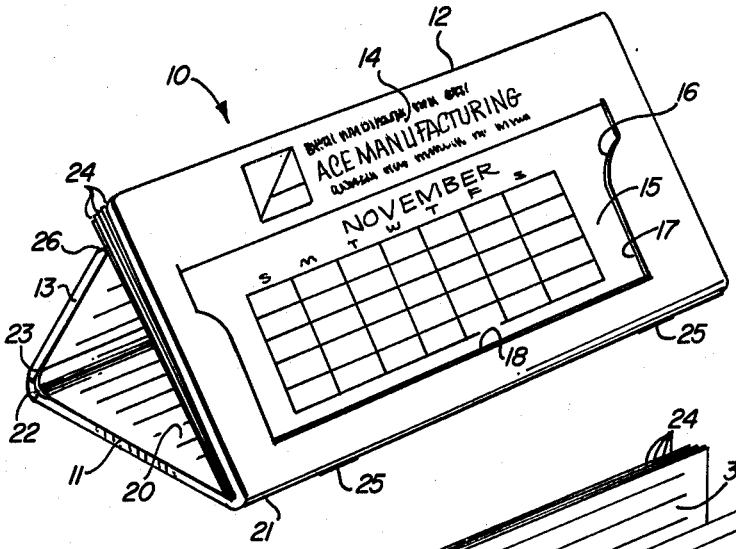
FIG. 1 is a perspective view of a display and book of the present invention in its set-up position.
Figure 2:
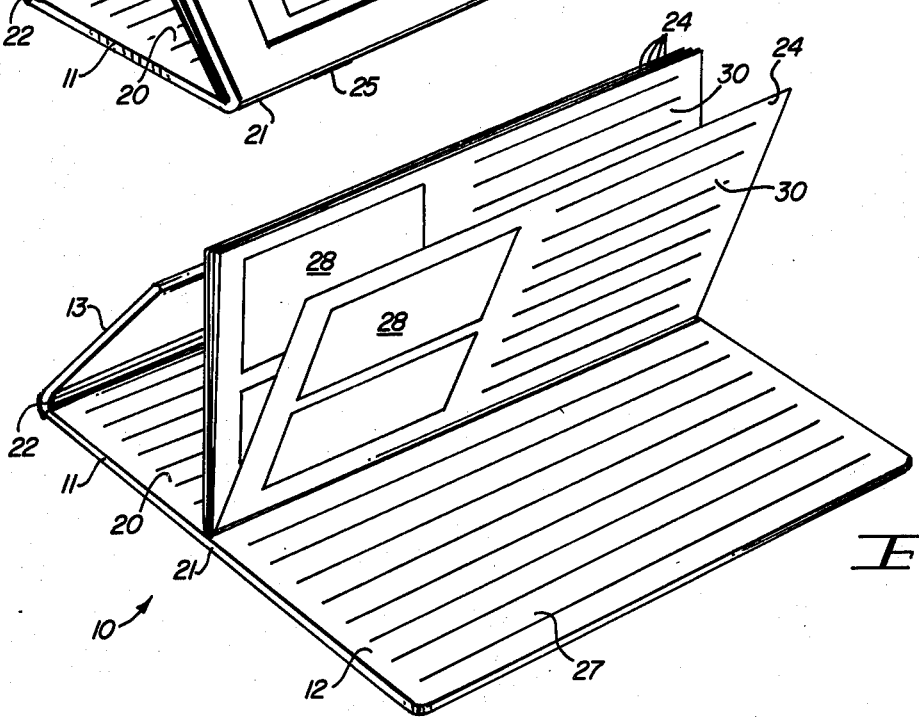
FIG. 2 is a perspective view of a display and book having the display panel folded forward.
Figure 3:
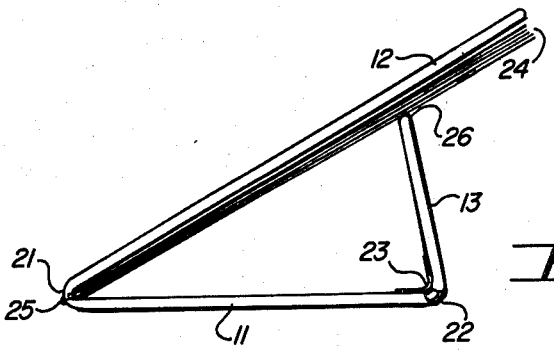
FIG. 3 is a side sectional view of the display panel of FIG. 1 in its set-up position.

In the position shown in FIG. 1, the calendar is always visible to the user. The front display panel 12, however, acts like the cover of a book, and may be swung forward as illustrated in FIG. 2, showing a plurality of printed lines 27 which might contain phone numbers or other reference information, thereby exposing the plurality of pages 24 of the book. The pages may have printed material 28 thereon, such as advertising from a plurality of advertisers, or pictorial displays along with lines 30 on alphabetically arranged pages for listing phone numbers and addresses, or other information, as desired. When the display panel 12 is flat on the desk, as in FIG. 2, the front of the upright pages 24 can be easily viewed, and the back of the folded forward pages 24 can be viewed by rotating the pages forward in contact and parallel to the display panel. This exposes the back of each subsequent page 24 which lies flat on the inside of the display panel 12 and provides a flat solid writing surface usually for recording personal names, adresses and phone numbers while exposing the next front display ad and printed alphabetical listings of other business numbers. The front area of each page in the book is angularly disposed against the upright panel and thus easily seen, while the back of each book page when rotated forward is flat on the front display panel for ease of writing on these pages. This important advantage does not exist with usual hard cover books. The book pages 24 are always disposed in a relatively upright but angular position against the top of the back panel 13 when the front display panel 12 is in display position. This is the normal position for desk calendar use and frequent reference to the monthly calendar pages with advertising copy usually in view above the calendar.

Thus, the user always has the calendar visible, and may flip the front panel 12 forward to look at a phone or reference book for commonly used information. In addition, the pages 24 can all be pulled forward to display the printed lines 20 on the base panel 11 and also on the upright support panel 13. In addition to the storage of pencils, pens, and the like, on the base panel, small slips of paper and notes can also be placed underneath the pages 24 for additional reference. The upright panel 13 can be folded flat, as illustrated in FIG. 4, allowing the book portion 24 and the display panel 12 to be collapsed into compact, easily mailable format, which can be set up by merely bending the upright support panel 13 on its aluminum hinge 23 to the position desired. The combination of the present invention advantageously allows the base and upright panels to be made of single panels of casebound paperboard separated by a hinge, preferably of ductile aluminum, while the front panel 12 can be made of one, two or three layers of paperboard, thereby reducing the cost of shipping individual units and eliminates the necessity for added layers of board for pop-up tongues to support an upright support panel, and does not restrict the space for letters and papers back of pages 24.

It should be clear at this time that a combination display mount and reference book has been provided which is easily manufactured by conventional techniques, and which provides multi-function as well as additional advertising space in both a multipage calendar and book. Accordingly, the present invention is not to be construed as limited to the forms show, which are to be considered illustrative rather than restrictive.

I claim:

1. A display and book combination comprising:

a base panel;

an upright support panel hinged to the back of said base panel with a flexible hinge whereby said upright support panel can be folded flat and angularly moved to an upright position;

a display panel hinged to said base panel and supported on the top edge of said upright support panel when in an upright position and adapted to be folded flat parallel to said base panel and upright support panel when said base panel is folded flat;

a plurality of book pages secured adjacent to the hinged area between said display panel and said base panel and supported by said upright support panel in an angular position between said upright support and said display panel and adapted to be folded flat between said base panel, upright support panel, and display panel when said upright support panel is folded flat; and said display panel and said plurality of book pages being selectively rotatable forward whereby the back of said display panels and book pages can be selectively positioned before a user.

2. A display and book combination in accordance with claim 1 in which said plurality of book pages includes a plurality of folded book pages having staples attaching said pages to the hinged portion between said display panel and said base panel.

3. The apparatus in accordance with claim 1, in which said display panel has a pocket formed in the face thereof and a calendar mounted in said pocket.

4. The apparatus in accordance with claim 3, in which said display panel has advertising material placed on the front of said display panel.

5. The apparatus in accordance with claim 4, in which said display panel is hinged to said base panel by case binding covering a portion of both panels.

6. The apparatus in accordance with claim 5, in which said display panel, base panel and upright support panel are casebound.

7. The apparatus in accordance with claim 6, in which the inside of said display panel has printed material thereon.

8. The apparatus in accordance with claim 7, in which said base panel and upright support panel each have printed material on one side thereof.

9. The apparatus in accordance with claim 1, in which said upright support panel is hinged with a hidden bendable aluminum hinge.

* * * * *